United States Patent [19]

Koper

[11] 4,102,690

[45] Jul. 25, 1978

[54] POWDER FOR CONTINUOUS CASTING

[76] Inventor: Janusz Koper, Hofherrgasse 6/27, 1100 Vienna, Austria

[21] Appl. No.: 676,428

[22] Filed: Apr. 13, 1976 (Under 37 CFR 1.47)

[30] Foreign Application Priority Data

Apr. 16, 1975 [AT] Austria ..... 2892/75

[51] Int. Cl.$^2$ ..... B28B 7/34

[52] U.S. Cl. ..... 106/38.28; 75/96; 106/38.27; 106/69; 106/286; 164/123

[58] Field of Search ..... 106/38.28, 38.27, 38.9, 106/69, 73.1, 117, 118, 120, 286; 249/197, 202; 75/96; 164/123

[56] References Cited

U.S. PATENT DOCUMENTS

| | | | |
|---|---|---|---|
| 3,649,249 | 3/1972 | Halley et al. | 164/56 |
| 3,708,314 | 1/1973 | Kishida et al. | 106/38.27 |
| 3,937,269 | 2/1976 | Salvadore et al. | 106/38.27 |
| 3,964,916 | 6/1976 | Armistead et al. | 106/38.27 |

*Primary Examiner*—Lorenzo B. Hayes
*Assistant Examiner*—Willie J. Thompson
*Attorney, Agent, or Firm*—Ernest F. Marmorek

[57] ABSTRACT

A flux powder for use in the continuous casting of steels, particularly aluminum killed steels in the form of a mechanical mixture of components and has the following chemical analysis by weight % :- silicon dioxide 20 - 60, calcium oxide source 20 - 60, calcium fluoride 3 - 20, alkali metal carbonate 3 - 20, carbon source 4 - 20 and aluminum oxide 0 - 10. At least the inorganic components of the mixture are substantially pure, whereby the properties of the powder may be made substantially uniform and reproducible. The components preferably have a uniform grain size and calcium carbonate is disclosed as a calcium oxide source and natural graphite is a preferred carbon source.

10 Claims, No Drawings

POWDER FOR CONTINUOUS CASTING

FIELD OF THE INVENTION

This invention relates to a flux powder which is suitable for use in the continuous casting of steels, including aluminum-killed steels, and which allows the casting rates to be high.

DISCUSSION OF PRIOR ART

A variety of flux powders have already been proposed for use in the continuous casting of steel. Where the principal component of the powder is fly ash, the highly fluctuating composition of the fly ash and thus the flux powders fails to ensure the required uniform action on the melt as casting proceeds. Flux powders of a composition that can be more precisely controlled have also been proposed. These may be based on Portland cement, a fluxing agent such as calcined soda, and a carbon source, such as carbon black, the specified content of aluminium oxide in such a powder being from 2 to 12 weight % and a particular ratio of lime to silica of from 0.7 to 1 being prescribed by adding an appropriate quantity of quartz powder. Another requirement is that the carbon black must have a grain size below 1 micron. It is apparent that it is not easy to comply with so many conditions, and that the production of the powder involves a relatively high expenditure in money and equipment.

It has also been proposed to provide, for use in the continuous casting of steel, a synthetic slag-forming material which, according to its chemical analysis, is composed of 10 to 55 weight % of silicon dioxide, 5 to 40 weight % of calcium fluoride, 5 to 30 weight % of sodium oxide and/or potassium oxide, 0.5 to 15 weight % of lithium oxide and/or lithium fluoride, up to 40 weight % of calcium oxide and up to 30 weight % of boron trioxide, the total quantity of boron trioxide, calcium fluoride and lithium fluoride combined being not less than 15 weight %. The mass itself must be brought into a molten condition by heating an appropriate quantity of the starting materials under specified temperature conditions, whereafter the molten mass is cooled and ground to provide a synthetic slag having specified values of flowability and plastic yield point. The finely divided slag mass may also be mixed with between 1 and 10 weight % of finely divided carbon. The complicated method of production of such a synthetic slag mass for use as a flux powder in continuous casting is also particularly expensive from the technical and cost points of view.

Another flux powder that has been proposed for continuous casting is a mechanical mixture of a very large number of different components, such as those usually present in the fly ash obtained by combustion of a bituminous coal and containing calcium and/or aluminum silicates and free carbon, with soda as a fluxing agent. With regard to these products which also contain ferric oxide, manganese dioxide, titanium dioxide and aluminum oxide in amounts constituting not less than one sixth of the total composition, the previously mentioned shortcoming also applies that the flux powder has highly variable properties which have a non-uniform effect on the resultant castings

BRIEF DESCRIPTION OF THE INVENTION

According to the present invention there is provided a flux powder for use in continuous casting, wherein the powder is a mechanical mixture of components of which the inorganic components are substantially pure, and wherein the powder has a composition according to the following chemical analysis:

| | |
|---|---|
| Silicon dioxide | 20 - 60 weight % |
| Calcium oxide source | 20 - 60 weight % |
| Calcium fluoride | 3 - 20 weight % |
| Alkali metal carbonate | 3 - 20 weight % |
| Carbon Source | 4 - 20 weight % |
| Aluminum oxide | 0 - 10 weight % |

The present flux powder composition, contains neither Portland cement nor fly ash, and consists of components which are each easily accessible in a state of purity and in a quality that do not vary. The flux powders present may be formulated so as to be particularly suitable for casting large cross sections and for high casting rates, and may form a uniform lubricating film for the casting besides ensuring the maintenance of a reducing atmosphere at the surface of the melt.

The inorganic components of the present flux powder are substantially pure in the sense of being chemically pure or at least technically or commercially pure products.

In contra distinction to previously proposed flux powders containing fly ash or slags of varying composition as basic components, the present flux powder consists of a mixture of pure raw materials of readily defined composition. By the selection of the components and an accurate adjustment of their chemical and/or mineral composition it is readily possible to ensure uniform fusion properties of the powder and the desired satisfactory results in the production of articles by continuous casting. When the present flux powder is used, an optimal fusion rate leads to the production of a mobile molten lubricant film of great uniformity, and, consequently, to the development of a very high quality surface on the casting. The composition of the flux powder maintains a reducing atmosphere at the surface of the metal melt and any undesirable oxidation is thus avoided. Moreover, slag ropes hardly ever appear. Furthermore, the present flux powder has a high absorption capacity for non-metallic inclusions. Finally, there is little flaming during use and no more than superficial oscillation marks appear on the casting.

A particular advantage of the present flux powder particularly when the calcium source is calcium carbonate, is the absence of a "lid"-forming tendency. This is understood to be the formation of a dense, gas-impervious, largely fused layer of flux powder which is unable to perform its functions as desired. Once the surface of the metal melt is entirely covered with such a "lid" or fused layer of powder, inclusions unavoidably remain in the metal. The entire casting process must then be stopped and the surface of the metal melt cleaned before pouring can be resumed. Alternatively, the "lid" may be thrust into the melt with long poles but this will result in severe contamination of the melt with impurities. The employment of the calcium oxide source in the form of calcium carbonate allows the carbon dioxide which is released by the decomposition of the carbonate to loosen up the powder layer, whilst at the same time the gas-filled pores provide good thermal insulation. The powder layer which thus remains porous throughout the pour also prevents the appearance of inclusions.

In the present flux powder which may be described as a "fully synthetic flux powder" because it consists of chemically well-defined pure starting materials, the two principal components silica and calcium oxide for instance in the form of powdered quartz and limestone, are the slag formers. The carbon monoxide which is intermediately formed during the decomposition of calcium carbonate when this is the calcium oxide source as well as the carbon monoxide which is formed during the combustion of the carbon source ensure the maintenance of the reducing atmosphere which is so desirable during the casting process.

While various materials can be used as carbon sources, natural graphite containing for instance 30 to 99 weight % of carbon is preferred, but forms of carbon which are as pure as carbon black, or forms such as bituminous coal or anthracite, can also be successfully used.

The fact that the present flux powder has a relatively low alumina content not exceeding about 10 weight % of $Al_2O_3$, has a favorable effect on the use of the powder in continuous casting processes, particularly when aluminum-killed steels are being cast. As known, a steel melt can absorb up to 8 weight % of alumina, and low alumina contents in the flux powder therefore favor the abstraction of alumina from the metal melt. The most useful composition of the flux powder regarding the components silica, calcium oxide and alumina will clearly be that corresponding to a relatively narrow region in the three-component diagram in which high contents of silica and calcium oxide are combined with low contents of 2 to 10 weight % of alumina. Since graphite usually contains a little alumina, it is generally unnecessary to add a special aluminum oxide component when natural graphite is the selected carbon source, or at least an aluminum oxide component may be added in quantities which are substantially less than those used when other carbon sources are employed; for instance a quantity not exceeding 8 weight % would be sufficient. If graphite is not used and the carbon source is carbon black or anthracite, additional aluminum oxide must naturally be introduced in order to obtain the desired composition range in the three-component diagram.

A flux powder according to the invention has the further advantage of being subject to less stringent conditions regarding grain size analysis than is usually necessary in the case of conventional casting auxiliaries. It will normally be sufficient if the mixed components have roughly similar grain sizes or analogous screen analyses. Moreover, their bulk densities should not differ too widely in order to obviate the risk of separation. A good screen analysis will be one in which from 30 to 70% of the grain has a diameter of from 0.5 to 0.045 mm.

PREFERRED EMBODIMENTS OF THE INVENTION

The invention will now be further illustrated by the following non-limiting Examples.

EXAMPLE 1

A flux powder for continuous casting is prepared by mixing a quartz powder containing 98 weight % of silica ground limestone, fluor spar powder, ground natural graphite containing 60 to 70 weight % carbon and calcined soda powder, the components being mixed dry until an intimate mixture of the components has been obtained. The grain size analysis of this mixture includes a proportion of 65% within the grain size limits of 0.5 to 0.045 mm.. By chemical analysis the composition is as follows:

| | |
|---|---|
| $SiO_2$ | 30 weight % |
| $CaCO_3$ | 40 weight % |
| $CaF_2$ | 15 weight % |
| $Na_2CO_3$ and/or $K_2CO_3$ | 5 weight % |
| C (in natural graphite) | 7.5 weight % |
| $Al_2O_3$ | 2.5 weight % |

The use of this flux powder for continuous casting is as follows. A melt of aluminum killed steel is cast with a casting speed of 0.32 to 1.25 m./minute in order to prepare slabs of dimensions 1295 × 225 mm.. The flux powder is uniformly spread on the surface of the liquid steel in the mold. The porous powder layer thereby obtained enables slabs to be made with flaw-free surfaces and without any noticeable inclusions. The consumption of flux powder is about 0.48 kg./metric ton of steel.

EXAMPLE 2

A steel melt killed with silicon and aluminum in theoretical equilibrium is poured in two parallel casting strands for the production of 540 × 135 mm. slabs. A withdrawal rate of from 1.5 to 2.5 meters/min. is maintained. A flux powder according to the invention is dropped on the surface of the metal pool in each casting mold, the analytical composition of the powder being as follows:

| | |
|---|---|
| $SiO_2$ | 27 weight % |
| $CaCO_3$ | 34 weight % |
| $Na_2CO_3$ and/or $K_2CO_3$ | 7 weight % |
| $CaF_2$ | 15 weight % |
| C (in natural graphite) | 9 weight % |
| $Al_2O_3$ | 8 weight % |

Even at the high casting rate here adopted an even layer of slag is formed which ensures the development of an excellent quality surface on the slab.

What is claimed is:

1. A flux powder having substantially uniform and reproducible properties for use in continuous casting, consisting essentially of an intimate mechanical mixture of:
   - silicon dioxide in an amount of 20–60% by weight,
   - calcium oxide source in an amount of 20–60% by weight,
   - calcium fluoride in an amount of 3–20% by weight,
   - alkali metal carbonate, in an amount of 3–20% by weight,
   - carbon source in an amount of 4–20% by weight and
   - aluminum oxide in an amount of 0–10% by weight, wherein the inorganic components of said mixture are present in a substantially pure state.

2. The flux powder of claim 1, wherein the carbon source is selected from the group consisting of natural graphite, carbon black, bituminous coal and authracite.

3. The flux powder of claim 1, wherein the carbon source is natural graphite and the content of aluminum oxide included as a separate component in said flux does not exceed 8% by weight.

4. The flux powder of claim 1, wherein the calcium oxide source is finely ground limestone.

5. The flux powder of claim 1, wherein the components are of substantially uniform grain size.

6. The flux powder of claim 5, wherein the components have a screen analysis of which 30% to 70% of the grains have a diameter of from 0.5 to 0.045 mm.

7. The flux powder of claim 1 consisting essentially of:

silicon dioxide in an amount of 30% by weight,
calcium carbonate in an amount of 40% by weight,
calcium fluoride in an amount of 15% by weight,
alkali metal carbonate in an amount of 5% by weight,
carbon as natural graphite in an amount of 7.5% by weight and aluminum oxide in an amount of 2.5% by weight.

8. The flux powder of claim 1 consisting essentially of:

silicon dioxide in an amount of 27% by weight,
calcium carbonate in an amount of 34% by weight,
calcium fluoride in an amount of 15% by weight,
alkali metal carbonate in an amount of 7% by weight,
carbon as natural graphite in an amount of 9% by weight and aluminum oxide in an amount of 8% by weight.

9. The flux powder of claim 1 which consists essentially of an intimate mechanical mixture of the following components:

silicon dioxide in an amount of 20–60% by weight,
calcium carbonate in an amount of 20–60% by weight,
calcium fluoride in an amount of 3–20% by weight,
alkali metal carbonate in an amount of 3–20% by weight,
said alkali metal carbonate being selected from at least one member of the group consisting of sodium carbonate and potassium carbonate
a carbon source in an amount of 4–20% by weight, said carbon source being selected from a member of the group consisting of natural graphite, carbon black, bituminous coal and anthracite and
aluminum oxide in an amount of 0–10% by weight, wherein said components are of substantially uniform grain size and each of said components is present in said mixture in a substantially pure state.

10. In a method of continuously casting steel, the use of a flux which consists essentially of an intimate mechanical mixture of:

silicon dioxide in an amount of 20–60% by weight,
calcium carbonate in an amount of 20–60% by weight,
calcium fluoride in an amount of 3–20% by weight,
alkali metal carbonate selected from at least one member of the group consisting of sodium carbonate and potassium carbonate in an amount of 3–20% by weight,
a carbon source in an amount of 4–20% selected from a member of the group consisting of natural graphite, carbon black, bituminous coal and anthracite and
aluminum oxide in an amount of 0–10% by weight, wherein said components are of substantially uniform grain size and each of said components is present in said mixture in a substantially pure state.

* * * * *